United States Patent [19]

Nash

[11] 3,971,295

[45] July 27, 1976

[54] CONTROL MEANS

[76] Inventor: Alan Richard Brine Nash, 39 Abbott's Ride, Farnham, England

[22] Filed: Sept. 11, 1974

[21] Appl. No.: 505,132

[30] Foreign Application Priority Data

Sept. 14, 1973 United Kingdom ..... 43297/73

[52] U.S. Cl. ..... 91/386; 91/387

[51] Int. Cl.[2] ..... F15B 13/16

[58] Field of Search ..... 91/387, 386, 417

[56] References Cited

UNITED STATES PATENTS

| | | | |
|---|---|---|---|
| 1,564,688 | 12/1925 | Kimball | 91/387 |
| 2,602,654 | 7/1952 | Parker | 91/387 |
| 2,770,246 | 11/1956 | Shafer et al. | 91/387 |
| 2,811,138 | 10/1957 | Clements | 91/386 |
| 3,257,912 | 6/1966 | Horst | 91/417 R |
| 3,693,501 | 9/1972 | Ward | 91/387 |

*Primary Examiner*—Paul E. Maslousky
*Attorney, Agent, or Firm*—Nichol M. Sandoe

[57] ABSTRACT

A positioner for a fluid-operated actuator has a fluid control valve displaced by a controlling force applied to a force-balance lever engaging one end of a biasing spring, the other end of which engages feedback means including an element displaceable by actuator movement. The valve lies between the biasing means and said feedback means element. Adjustment means are provided for the spring and for the feedback means to set the actuator zero position and movement range. Fluid conduits from the valve comprise open channels in a unitary member containing the valve and with a wall of a housing form closed section passages to porting in said wall opening directly into the actuator porting.

9 Claims, 8 Drawing Figures

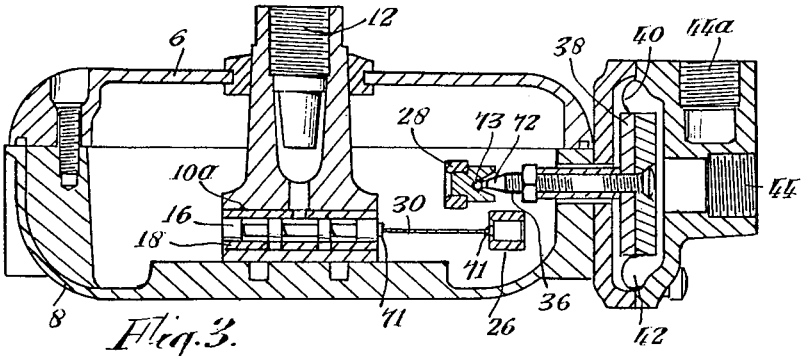
Fig. 3.
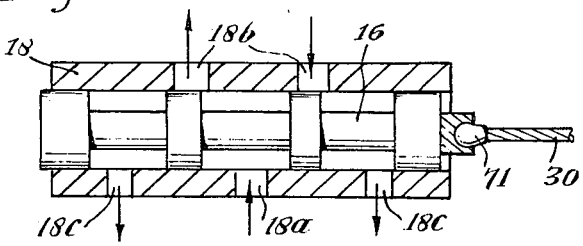
Fig. 4.
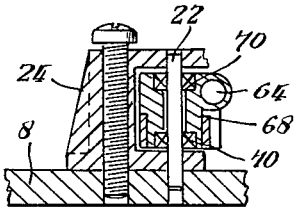
Fig. 5.
Fig. 6.
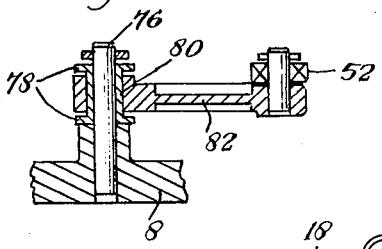
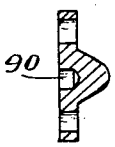
Fig. 8.
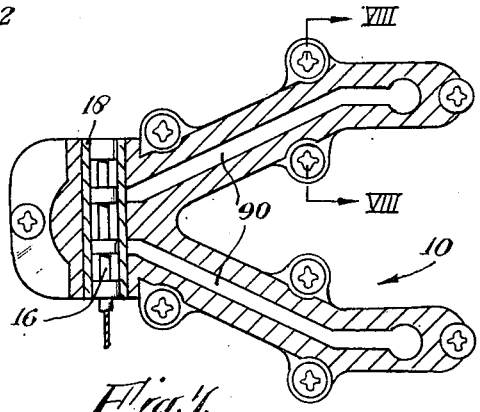
Fig. 7.

CONTROL MEANS

BACKGROUND OF THE INVENTION

This invention relates to rotary actuators and with the provision of means whereby the angular position of such actuators can be controlled.

The invention is particularly concerned with positioning means for use with a rotary actuator said means comprising a control valve for admitting pressure fluid to the actuator and biasing means acting to urge said control valve to a state in which the fluid pressure will be supplied to the actuator to move it to one end position, the control valve being displaceable against said biasing means by a controlling force to move the actuator away from said position. The positioning means further include feedback means for connection to the actuator to be responsive to said actuator movement for modifying the action of the biasing means on the control valve, whereby the control valve is brought to a neutral position by the resultant action of said feedback and biasing means with said controlling force, said neutral position being obtained at an actuator position dependent upon the magnitude of said controlling force.

One object of the invention is to provide positioning means that can be connected directly to its actuator without external pressure fluid connections.

Another object of the invention is to provide positioning means of a more compact form than has hitherto been obtained.

A further object of the invention is to provide positioning means that comprises a diecast or moulded valve body in which the required fluid conduits are provided in a manner that avoids or reduces the need for subsequent drilling operations in the formation of said conduits and that also avoids or reduces the need for fluid-tight joints to be made between parts of the positioning means itself.

SUMMARY OF THE INVENTION

According to one aspect of the invention, in a positioning means of the form described, the control valve is disposed between the biasing means and an element of said feedback means that is displaced with the actuator movement. The said element and the biasing means may be interconnected by a member or members disposed on an opposite side of the control valve to that on which is disposed an interconnection between the control valve and the biasing means.

According to another aspect of the invention, the control valve is disposed in a member having integrally formed open channels for providing fluid connections between the valve and the actuator, said member being secured to a base or cover that co-operates with the channels to define therewith closed cross-section passages communicating with porting for connection to associated fluid porting of the actuator. Said base or cover may have means for face mounting onto the actuator with said porting of the positioning means opening directly into said actuator porting.

BRIEF DESCRIPTION OF THE DRAWINGS

The invention will be more particularly described by way of example with reference to the accompanying drawings, wherein:

FIGS. 2 and 3 are sectional views of the unit in FIG. 1 on the lines II—II and III—III respectively, the feedback lever assembly and control spring being omitted from the latter figure;

FIG. 4 is a detail illustration of the control valve of the unit in the preceding figures;

FIG. 5 is a detail sectional view on the line V—V of the force-balance lever of the unit in the region of the lever pivot;

FIG. 6 is a detail sectional view on the line VI—VI of the feedback lever assembly of the unit in the region of the lever assembly pivot;

FIG. 7 is a plan sectional view of the distribution member of the unit; and

FIG. 8 is a sectional view of one arm of the distribution member on the line VIII—VIII of FIG. 7.

DESCRIPTION OF THE PREFERRED EMBODIMENT

Figure 1:
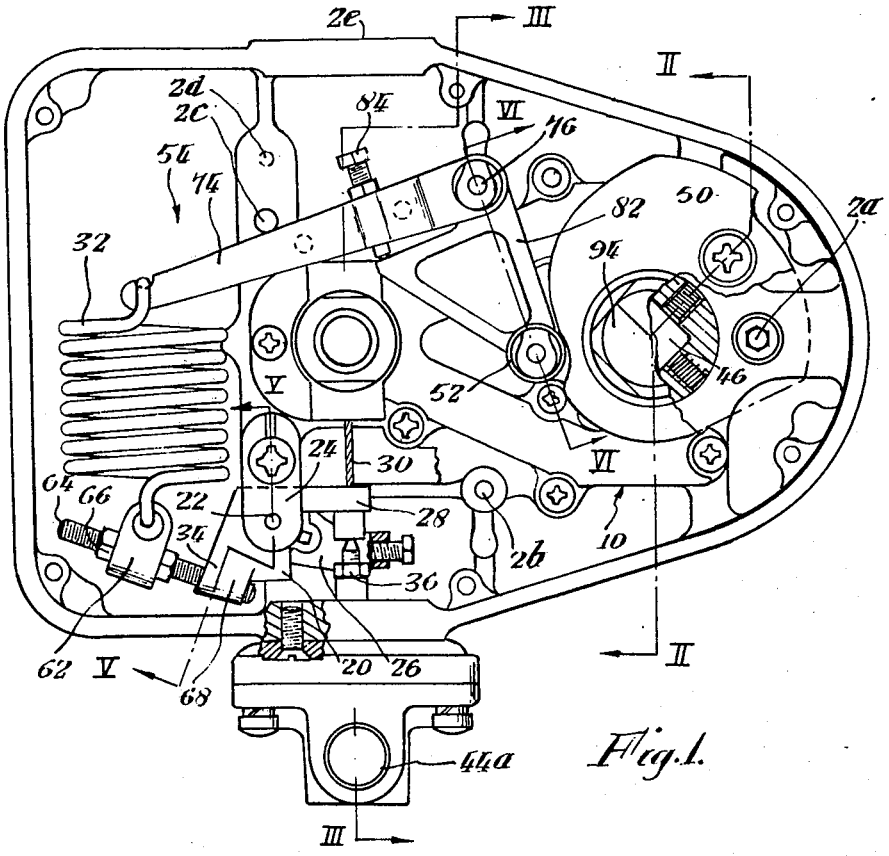
FIG. 1 is a plan view of a unit incorporating positioning means according to the invention, the cover of the unit being omitted.
Figure 2:
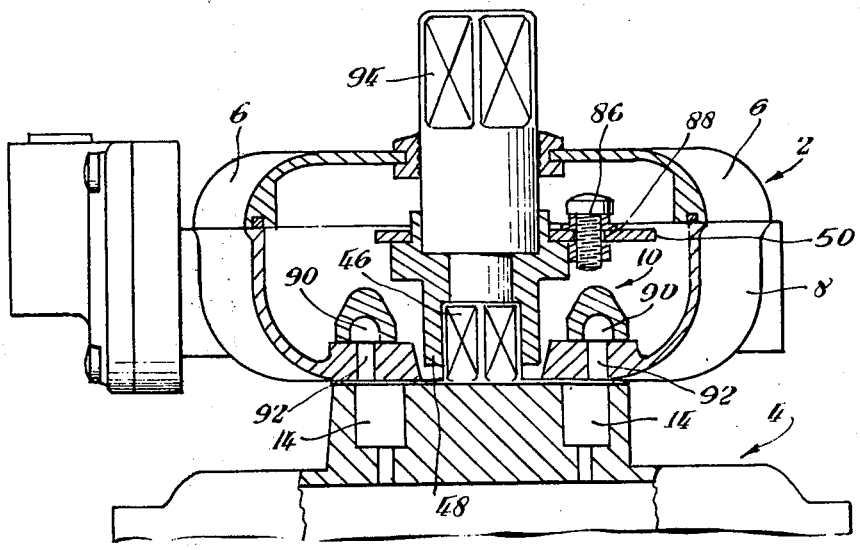

Referring to the drawings, the positioning means are provided as a unit 2 secured by bolts such as 2*a* direct onto the upper face of a rotary actuator 4 that is to be controlled by the means. The unit 2 has a protective outer casing formed by upper and lower parts 6, 8 within which is mounted a pressure fluid distribution member 10. Pressure fluid at a pressure of 80 to 100 psi for movement of the actuator is supplied through an inlet connection 12 of the distribution member, by way of conduits that are described in detail below, to ports 14 of the actuator 4. The actuator itself may be of known design and a detailed description is therefore not necessary. It may, for example, take the form illustrated in British patent specification No. 1,023,232 comprising a fluid chamber divided by a vane that is mounted on a pivotable output shaft and that is angularly displaceable by admitting pressure fluid to one side or other of said chamber.

The flow through the ports 14 is determined by a control valve comprising a spool 16 slidable in a valve sleeve 18 that is a press fit in a bore 10*a* of the distribution member. As FIG. 4 shows more clearly, the sleeve has five ports, pressure air from the inlet connection 12 being supplied to the central port 18*a* from which it is directed to one or other of a pair of ports 18*b* connected to opposite sides of the actuator fluid chamber when the valve spool is spaced to one side or the other of a central neutral position. The two outer ports 18*c* function as exhaust ports communicating with openings (not shown) to atmosphere in the casing lower part 8.

Movement of the spool from the neutral position brings one or other exhaust port into communication with its adjacent port 18*b* to provide an outlet route from one side of the actuator fluid chamber while the other side of the chamber is connected by its associated port 18*b* to the pressure air supply from the inlet connection 12. Displacement of the spool 16 from the neutral position thus admits pressure air to one side or other of the actuator to pivot the actuator output shaft accordingly.

The valve spool 16 is displaced by means of a force-balance lever 20 having a pivot 22 mounted on a bracket 24. The lever 20 has a bifurcated arm consisting of limbs 26, 28, the first of which is connected to the valve spool 16 by a flexible steel cable 30. A biasing spring 32 is attached to the lever arm 34 on the oppposite side of the pivot 22 to the limbs 26, 28. The second limb 28 of the bifurcated lever arm is disposed above the cable connection and is itself connected to a push rod 36 forming an extension of a piston 38 mounted on a sealing diaphragm 40 in a control pressure chamber 42 secured to the side of the outer casing lower part 8. A pneumatic pressure signal can be applied to inlet union 44 or 44*a* of the chamber to act on the piston and diaphragm, the space on the opposite side of the diaphragm being vented to the casing interior, to apply a moment to the lever 20 acting in opposition to the moment on the lever from the biasing spring and, depending upon the balance of forces, so displacing the control valve spool.

The actuator output shaft comprises an upwardly projecting end 46 which extends into the positioning unit casing, where a socket 48 of the unit is secured to the shaft to rotate with it. A cam 50 secured to the socket also rotates with the shaft and a ball race follower 52 for the cam is provided on a feedback lever assembly 54 pivoted on the unit casing and attached at its other end to the biasing spring 32 which is thus held in tension between the force-balance lever 20 and the feedback lever assembly 54.

The arrangement is such that with no signal pressure on the piston and diaphragm the pressure air supply from the inlet connection 12 will hold the actuator shaft in an extreme clockwise position (as seen from above). Application of a signal pressure, typically between 3 psi and 15 psi, to the diaphragm displaces the control valve spool 16 so as to rotate the actuator shaft anti-clockwise. This pivots the lever assembly 54 clockwise, because of the movement of the cam 50 increasing the biasing spring tension and so causing the spring to pivot the force-balance lever clockwise too. The valve spool being connected to the force-balance lever, it is displaced thereby in the opposite direction to the displacement caused by the signal pressure, whereby the spool is returned to a neutral position in which no further pressure fluid is supplied to the actuator. The actuator shaft position at which this state of equilibrium is obtained will depend upon the magnitude of the signal pressure which can thus be regulated to give a desired movement of the actuator shaft.

The connection of the spring 32 to the force-balance lever is variable in its distance from the pivot 22 to adjust the rate of change of actuator movement with respect to signal pressure. This adjustability is obtained by displacing a sleeve connector 62, to which the spring 32 is attached by a low-friction bearing, along a screw-threaded arm 64 of the lever, the sleeve connector being locked in position by nuts 66. The oblique setting of the arm 64 at some 70° to the axis of the spring 32 means that as the sleeve connector 62 is moved to increase the spring tension (i.e. to the right as seen in FIG. 1) the radius of action of the spring force about the pivot 22 decreases. This facilitates initial calibration of the unit as will be described below.

The arm 64 is screwed into hub 68 of the lever which is mounted through rolling bearings 70 on the pivot 26 since friction forces on the force-balance lever should be kept to a minimum, and the hub 68 has the arms 22, 32, integrally formed with it. The cable 30 between the lever limb 26 and the valve spool 16 has soldered connections 71 to said limb and spool. It is of a multi-strand construction, such as is known for the inner member of a Bowden cable, and is relatively stiff axially while having some bending flexibility. This arrangement eliminates backlash but allows the small amount of relative angular movement that occurs with pivoting of the lever 20, and is moreover resistant to accidental damage. The push rod 36 has a tapered end 72 that is urged against a bearing ball 73 seated in a recess in the lever limb 28. The form of the recess prevents all but very slight lateral displacements of the push rod and its tapered end rolls on the ball 73 with pivoting of the lever 20, so avoiding sliding friction forces.

The lever assembly 54 comprises an arm 74 extending between the spring 32 and pivot pin 76 by which the lever assembly is attached to the casing lower part 8. As FIG. 6 shows, the arm 74 has a forked end 78 between the limbs of which a mounting bush 80 is secured. The lever assembly further includes a bell crank lever 82 which carries the cam follower 52, bearing rotatably on the outer surface of the bush 80. The arm 74 and the lever 82 can thus pivot relative to each other and an adjusting screw 84 on the arm 74 determines their relative angular positions, the spring 32 urging the end of the screw into abutment with the bell crank lever as well as holding the follower 52 in contact with the cam 50.

Connection between the control valve and the actuator porting is by way of channels formed integrally in the distribution member 10 as recesses 90 in its underface. When the unit is assembled and the member is screwed down onto flat upper face of the casing lower part 8, said face and the recesses together form closed cross-sction conduits that extend from the valve sleeve 18 to ports 92 in said casing lower part opening directly into the porting 14 of the actuator, as already described. This manner of forming the fluid conduits between the control valve and the actuator porting simplifies manufacture of the positioning unit since the distribution member can be cast or moulded with the recesses 90 formed at the same time without them requiring moulding cores or subsequent machining.

By turning the screw to move the arm 74 clockwise about the pivot pin 76, the neutral tension in the spring 32 is increased whereby the portion of the cam profile utilised over the stroke of the actuator is varied. The cam 50 is secured to the socket 48 by a bolt 86 passing through arcuate slot 88 in the cam so providing for a similar adjustment of the unit. With a cam profile giving a linear response both these forms of adjustment are equivalent and only one need be used. If the cam has a non-linear profile, however, the use of both adjustments may be required to determine the total angular movement obtained and which portion of the cam profile is utilised for this movement.

It can be arranged that the angular setting of the cam relative to the actuator shaft is determined on initial assembly to ensure that a predetermined portion of the cam periphery is utilised. Calibration will then be required to provide the intended full angular movement, say 90°, of the actuator shaft between a specific zero or minimum setting, with a signal pressure on the piston 38 of, for example, 3 psi, and a specific maximum setting with a signal pressure on the piston 38 of, for example, 15 psi. This can be performed in the following manner.

The rquired angular position of the actuator shaft can be obtained at the zero setting first by adjusting the screw 84 to alter the state of the lever assembly 54 and thereby alter the tension in the spring 32, so adjusting the balance of forces on the lever 20. With the actuator shaft position adjusted thereby to a first end position, it is necessary to ensure that application of the maximum signal pressure will give the required full shaft movement. Any deviation observed when the maximum signal pressure is applied is corrected by adjusting the position of the spring connector 62 on the aarm 64 of the force-balance lever 20. As has already been described, because this adjustment alters both the spring tension and its radius of action about the pivot 22, it has no effect or only a negligible effect on the zero setting previously obtained. The relationship between the actuator shaft position and intermediate signal pressures is of course determined by the profile of the cam.

The socket 48 has a shaft extension 94 non-rotatably secured to it. This can serve for mounting an indicator showing the actuator position and/or for providing a purchase to allow the actuator to be rotated manually or the positioning means to be otherwise over-ridden.

The casing lower part 8 shown in FIG. 1 can be seen to have some further apertures that are intended for mounting the positioned mechanism to permit an opposite-handed arrangement of the mechanism. Thus, there is an aperture 2*b* on which the feedback lever assembly can be pivoted and further apertures exist at 2*c* and 2*d* for the bracket 24 and for the force-balance lever pivot 22. Alternative mounting means 2*e* are provided similarly for the control-pressure chamber 42. Signal pressures then rotate the actuator in the opposite direction.

What I claim and desire to secure by Letters Patent is:

1. Positioning means for use with an actuator having a chamber, a displaceable member in said chamber and porting leading to the chamber at opposite sides of the member for admission of pressure fluid to displace the member in the chamber, an element connected to and displaceable with said member being engageable from the exterior of the actuator for transmission of the motion of the member, the positioning means comprising, in combination, a control valve, means connecting said valve to said actuator chamber, biasing means and interconnection between said biasing means and the control valve for transmitting a force from said biasing means urging the valve to a state in which the fluid is supplied to the actuator chamber to move the displaceable member to one end position, means for applying a controlling force to the control valve to move it against the action of the biasing means, feedback means comprising an element connected to said transmission element of the actuator for movement by said element and said feedback means further comprising a lever, pivot means supporting the lever intermediate its extent, opposite end portions of the lever projecting in different directions from said pivot means, one end portion of the lever engaging said element of the feedback means, the other end portion being connected to a first region of the biasing means for modifying the action of the biasing means on the control valve in dependence upon the movement of said transmission element, whereby the control valve is brought to a neutral position by the resultant action of said feedback and biasing means with said controlling force means, said neutral position being obtained at an actuator position dependent upon the magnitude of said controlling force, the control valve being disposed between the biasing means and said element of the feedback means, and the feedback means lever being adjacent one side of the control valve, said interconnection means being connected to a region of the biasing means remote from said first region and being adjacent to the opposite side of the control valve.

2. Positioning means according to claim 1 wherein said end portions are separate elements of the lever mutually displaceable relative to each other, and adjustment means are provided on the lever for controlling the relative positions of said elements.

3. Positioning means according to claim 2 wherein pivot connections are provided on each of said end portion elements said pivot connections engaging said lever pivot means whereby the elements are pivotable relative to each other on a common axis under the control of said adjustment means.

4. Positioning means according to claim 1 further comprising a pivot, and in which said interconnection means between the biasing means and the control valve comprises a lever mounted on said pivot and connected to the biasing means and to the valve for transmission of a force from the biasing means to displace the valve, an engagement element on the lever for said connection of the biasing means thereto, adjustment means for displacement of the engagement element towards and away from said pivot to adjust the moment of the force of the biasing means on the lever.

5. Positioning means according to claim 4 wherein the control valve comprises a transversely displaceable valve spool, and a cable that is axially stiff but capable of limited bending flexibility links said spool to the lever.

6. Positioning means according to claim 4 wherein an arm of said lever carrying said engagement element is oriented relative to the biasing means such that displacement of the engagement element away from the pivot reduces the force applied to the lever by the biasing means.

7. Positioning means for use with an actuator having a chamber, a displaceable member in said chamber and porting leading to the chamber at opposite sides of the member for admission of pressure fluid to displace the member in the chamber, an element connected to and displaceable with said member being engageable from the exterior of the actuator for transmission of the motion of the member, the positioning means comprising, in combination, a housing element, a carrier member secured thereon, a control valve mounted in said carrier member, said carrier member having a face along which are integrally formed open channels extending along said face, said face being disposed contiguously to said housing element for said channels to define therewith closed crosssection passages providing fluid connections between the valve and said actuator porting, biasing means connected to the control valve for urging the valve to a state in which the fluid is supplied to the actuator chamber to move the displaceable member to one end position, means for applying a controlling force to the control valve to move it against the action of the biasing member, feedback means connected to said transmission element of the actuator and thereby responsive to the movement of said displaceable actuator member, said feedback means being connected to the control valve for modifying the action of the biasing means, whereby the control valve is brought to a neutral position by the resultant action of said feedback and biasing means with said controlling force means, said neutral position being obtained at said actuator position dependent upon the magnitude of said controlling force.

8. Positioning means according to claim 7 having an outer face of said housing element directed towards the actuator, terminal openings of said passages in said face and means for mounting the positioning means on the actuator to locate said openings in direct registration with the actuator porting.

9. Positioning means according to claim 7 wherein said carrier member comprises an inlet union for connection to a compressed air supply and integral exhaust ports leading from the control valve for the release of pressure air from the actuator chamber in dependence upon the positioning of the control valve.

* * * * *